US010164341B2

(12) United States Patent
Tsai

(10) Patent No.: US 10,164,341 B2
(45) Date of Patent: Dec. 25, 2018

(54) FLAT ANTENNA

(71) Applicant: TRANS ELECTRIC CO., LTD., Changhua (TW)

(72) Inventor: Kun-Cheng Tsai, Changhua (TW)

(73) Assignee: TRANS ELECTRIC CO., LTD., Changhua (TW)

( * ) Notice: Subject to any disclaimer, the term of this patent is extended or adjusted under 35 U.S.C. 154(b) by 0 days.

(21) Appl. No.: 15/641,477

(22) Filed: Jul. 5, 2017

(65) Prior Publication Data

US 2018/0277959 A1 Sep. 27, 2018

(30) Foreign Application Priority Data

Mar. 27, 2017 (TW) ..... 106204263 U

(51) Int. Cl.
*H01Q 9/16* (2006.01)
*H01Q 9/40* (2006.01)
*H01Q 19/32* (2006.01)

(52) U.S. Cl.
CPC ..... *H01Q 9/40* (2013.01); *H01Q 19/32* (2013.01)

(58) Field of Classification Search
None
See application file for complete search history.

(56) References Cited

U.S. PATENT DOCUMENTS 6,339,409 B1 * 1/2002 Warnagiris ..... H01Q 9/28 343/793
6,417,816 B2 * 7/2002 Sadler ..... H01Q 1/243 343/702
6,836,250 B2 * 12/2004 Dai ..... H01Q 1/38 343/700 MS
7,324,058 B2 * 1/2008 Kai ..... H01Q 1/22 343/793
7,446,727 B2 * 11/2008 Kai ..... G06K 19/07786 340/572.7
9,570,797 B2 * 2/2017 Wang ..... H01Q 1/007
2004/0056803 A1 * 3/2004 Soutiaguine ..... H01Q 9/0414 343/700 MS
2004/0104853 A1 * 6/2004 Chen ..... G06F 1/1616 343/702
2004/0169612 A1 * 9/2004 Song ..... H01Q 9/26 343/783

(Continued)

FOREIGN PATENT DOCUMENTS

TW M496247 U 2/2015

*Primary Examiner* — Trinh Dinh

(74) *Attorney, Agent, or Firm* — McClure, Qualey & Rodack, LLP

(57) ABSTRACT

A flat antenna includes a pair of radiation units that are spaced apart from each other and that are symmetrical with respect to a symmetrical axis. Each of the radiation units includes a main radiating body, an auxiliary radiating body and a feed-in point. The main radiating body has a substantially triangular shape and includes a first angle close to the symmetrical axis, a second angle far from the symmetrical axis with respect to the first angle, and an edge between the first and second angles and obliquely facing the symmetrical axis. The auxiliary radiating body is connected to the main radiating body, and extends from the first edge toward the symmetrical axis. The feed-in point is formed on the first angle of the main radiating body.

13 Claims, 4 Drawing Sheets

(56) References Cited

U.S. PATENT DOCUMENTS

| | | | | |
|---|---|---|---|---|
| 2007/0046557 | A1* | 3/2007 | Chen | H01Q 9/26 343/795 |
| 2008/0278380 | A1* | 11/2008 | Miyoshi | H01Q 1/2258 343/700 MS |
| 2011/0248899 | A1* | 10/2011 | Bourtoutian | H01P 1/2039 343/795 |
| 2013/0082891 | A1* | 4/2013 | Han | H01Q 9/16 343/793 |
| 2014/0078009 | A1* | 3/2014 | Wong | H01Q 1/521 343/728 |
| 2014/0132468 | A1* | 5/2014 | Kim | H01Q 9/285 343/793 |

* cited by examiner

FLAT ANTENNA

CROSS-REFERENCE TO RELATED APPLICATION

This application claims priority of Taiwanese Patent Application No. 106204263, filed on Mar. 27, 2017.

FIELD

The disclosure relates to an antenna, and more particularly to a flat antenna.

BACKGROUND

It is a worldwide trend to broadcast television programs by transmitting digital television signals. No matter which digital television broadcast standard is used, such as Digital Video Broadcasting-Terrestrial (DVB-T) or Advanced Television Systems Committee (ATSC), it is necessary to use an antenna capable of receiving both very high frequency (VHF) radio waves and ultra high frequency (UHF) radio waves in order to receive the digital television signals.

Taiwanese Utility Model Patent No. M496247 discloses a conventional flat antenna for receiving digital television signals. The conventional flat antenna includes a pair of main radiating bodies formed with feed-in apertures, and an auxiliary radiating body connected between the pair of main radiating bodies. Each of the main radiating bodies has a substantially triangular shape. The main radiating bodies cooperatively serve as a bow-tie antenna having a broad frequency range, while the auxiliary radiating body makes the conventional flat antenna further operate as a folded dipole antenna so as to increase the bandwidth and to improve impedance matching.

However, the conventional flat antenna has relatively poor antenna gain in the VHF range, affecting image quality of the television programs. In addition, the conventional flat antenna has loop current thereon due to the configuration of the folded dipole antenna, and any conductor near the conventional flat antenna may influence distribution of the loop current. Therefore, positioning of a coaxial cable can greatly affect performance of the conventional flat antenna.

SUMMARY

Therefore, an object of the disclosure is to provide a flat antenna that can alleviate at least one of the drawbacks of the prior art.

According to an aspect of the disclosure, the flat antenna includes a pair of radiation units that are spaced apart from each other and that are symmetrical with respect to a symmetrical axis. Each of the radiation units includes a main radiating body, an auxiliary radiating body and a feed-in point.

The main radiating body has a substantially triangular shape and includes a first angle close to the symmetrical axis, a second angle and a third angle far from the symmetrical axis with respect to the first angle, a first edge between the first and second angles and obliquely facing the symmetrical axis, a second edge between the first and third angles, and a third edge between the second and third angles.

The auxiliary radiating body is connected to the main radiating body, and extends from the first edge toward the symmetrical axis.

The feed-in point is formed on the first angle of the main radiating body.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
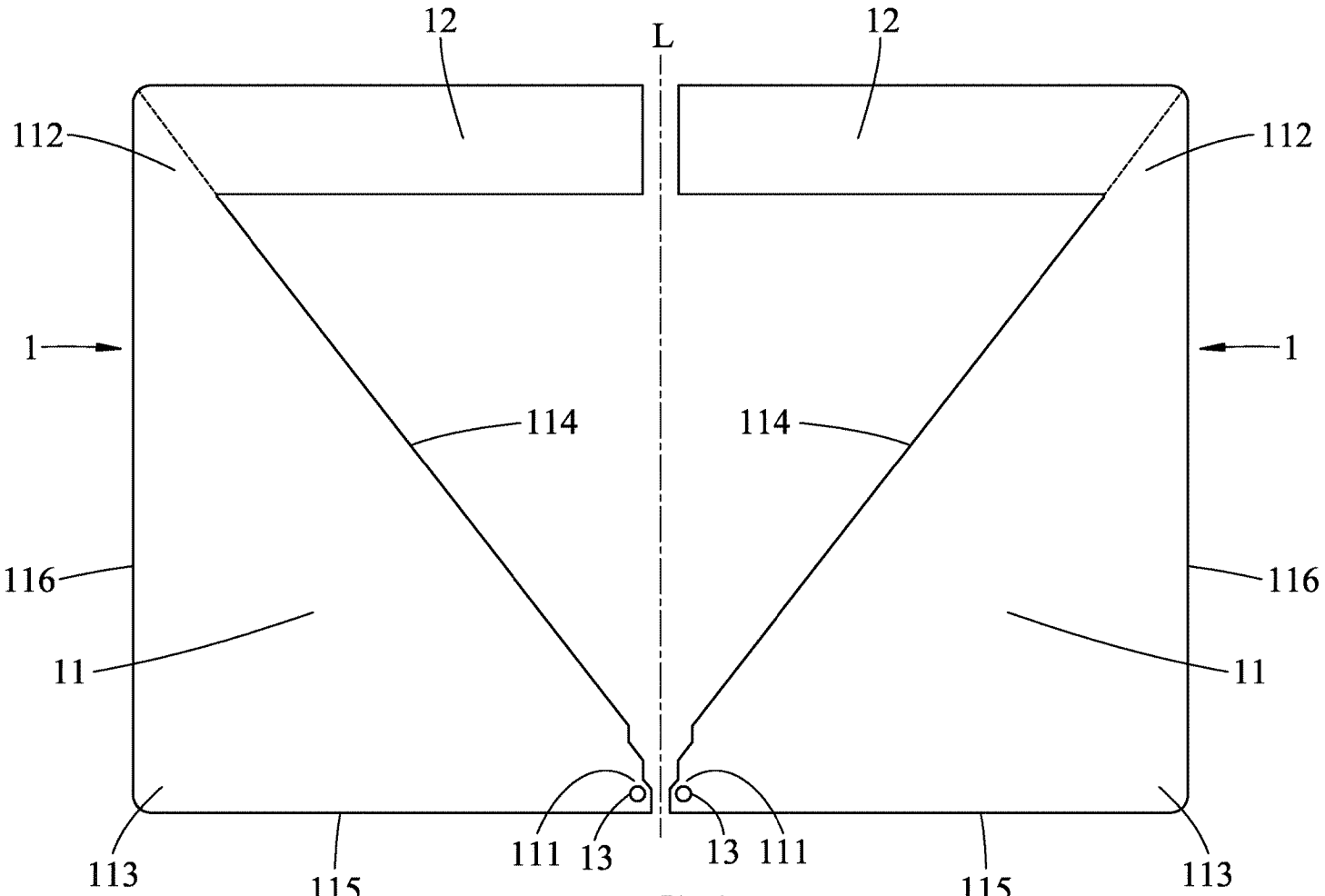
FIG. 1 is a schematic view of a first embodiment of the flat antenna according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, a first embodiment of a flat antenna according to the disclosure includes a pair of radiation units 1. In the first embodiment, the radiation units 1 are substantially made of aluminum foil. In other embodiments, the radiation units 1 may be made of other metallic foil (e.g., copper foil). In practice, the radiation units 1 may be disposed in a housing that is made of non-conductive material (e.g., plastic).

The radiation units 1 are spaced apart from each other, and are symmetrical with respect to a symmetrical axis (L). Each of the radiation units 1 includes a main radiating body 11, an auxiliary radiating body 12 and a feed-in point 13.

The main radiating body 11 has a substantially triangular shape, and includes a first angle 111 close to the symmetrical axis (L), a second angle 112 and a third angle 113 far from the symmetrical axis (L) with respect to the first angle 111, a first edge 114 between the first angle 111 and the second angle 112 and obliquely facing the symmetrical axis (L), a second edge 115 between the first angle 111 an the third angle 113, and a third edge 116 between the second angle 112 and the third angle 113. In the first embodiment, the third edge 116 is substantially parallel with the symmetrical axis (L), and the second edge 115 is substantially perpendicular to the third edge 116. However, the geometric relationship among the second and third edges 115, 116 and the symmetrical axis (L) is not limited to the foregoing disclosure.

The auxiliary radiating body 12 is connected to the second angle 112, and extends from the first edge 114 toward the symmetrical axis (L). In the first embodiment, the auxiliary radiating body 12 is substantially elongated, and extends in a first direction substantially perpendicular to the third edge 116. However, the configuration of the auxiliary radiating body 12 is not limited to the disclosure of this embodiment.

Each of the feed-in points 13 is in a form of an aperture formed on the first angle 111 of the main radiating body 11 of a respective one of the radiation units 1. The feed-in points 13 are configured to be connected with a coaxial cable (not shown). In particular, one of the feed-in points 13 is connected to a center core of the coaxial cable, and another one of the feed-in points 13 is connected to a metallic shield of the coaxial cable as an electrical ground.

It should be noted that the radiation units 1 are not directly connected to each other (i.e., there is no physical connection therebetween), and thus, there is no loop current generated on the radiation units 1 between the feed-in points 13.

Figure 2:
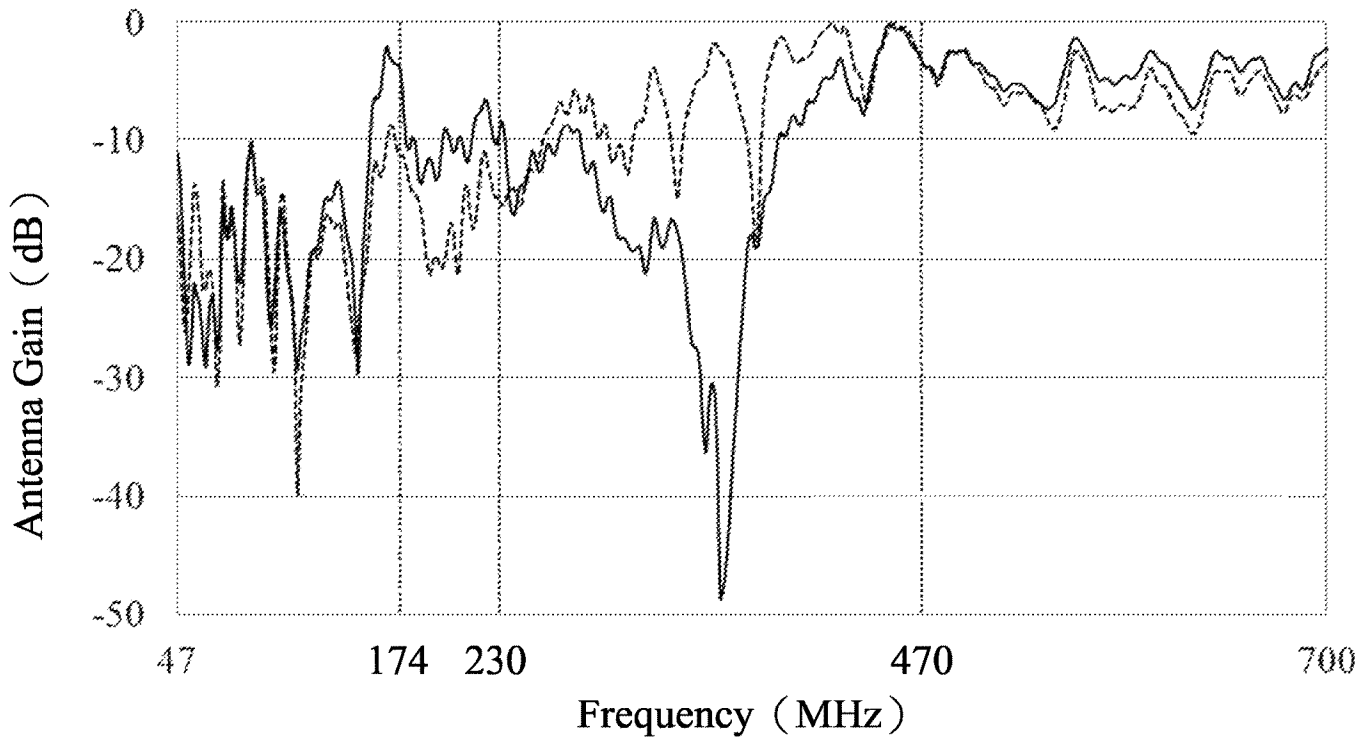
FIG. 2 is a plot showing antenna gain of the conventional flat antenna and the first embodiment of the flat antenna operating at a frequency range from 47 MHz to 700 MHz.

Referring to FIGS. 1 and 2, detailed physical dimensions and antenna gain of the flat antenna of the first embodiment according to the disclosure are described below. In the first embodiment, a width of the auxiliary radiating body 12 falls in a range between 10 mm and 50 mm. In some embodiments, the width of the auxiliary radiating body 12 falls in a range between 25 mm and 35 mm.

In order to enhance the antenna gain of the flat antenna in a very high frequency (VHF) range (particularly in a frequency range between 174 MHz and 230 MHz used for digital television channels), for each of the radiation units 1, dimensions of the main radiating body 11 and the auxiliary radiating body 2 are specified below.

For enhancing the antenna gain of the flat antenna operating at a frequency band between 140 MHz and 174 MHz, a sum of a length of the second edge 115, a length of the third edge 116 and a length of the auxiliary radiating body 12 falls in a range between 430 mm and 530 mm. In some embodiments, the sum of the foregoing three lengths falls in a range between 460 mm and 500 mm. In the first embodiment, a ratio of the length of the second edge 115 ($L_{115}$) to the length of the third edge 116 ($L_{116}$) is 0.75:1, while a ratio of the length of the third edge 116 ($L_{116}$) to the length of the auxiliary radiating body 12 ($L_{12}$) is 1:0.65 (i.e., $L_{115}$:$L_{116}$:$L_{12}$=0.75:1:0.65). It should be noted that the dimensional relationship among the second edge 115, the third edge 116 and the auxiliary radiating body 12 is not limited to this disclosure.

In order to enhance the antenna gain at a frequency band between 150 MHz and 250 MHz, a sum of a length of the first edge 114 ($L_{114}$) and the length of the third edge 116 ($L_{116}$) falls in a range between 300 mm and 480 mm. In some embodiments, the sum of the length of the first edge 114 ($L_{114}$) and the length of the third edge 116 ($L_{116}$) falls in a range between 440 mm and 480 mm. In the first embodiment, the ratio of the length of the first edge 114 to the length of the third edge 116 is 1.3:1 ($L_{114}$:$L_{116}$=1.3:1), but is not limited to this disclosure.

In order to enhance the antenna gain at a frequency band between 180 MHz and 220 MHz, a sum of the length of the first edge 114 ($L_{114}$) and the length of the auxiliary radiating body 12 ($L_{12}$) falls in a range between 340 mm and 420 mm. In some embodiments, the sum of the length of the first edge 114 ($L_{114}$) and the length of the auxiliary radiating body 12 ($L_{12}$) falls in a range between 370 mm and 410 mm. In the first embodiment, a ratio of the length of the first edge 114 to the length of the auxiliary radiating body 12 is 2:1 ($L_{114}$:$L_{12}$=2:1), but is not limited to this disclosure.

In order to enhance the antenna gain in a frequency band between 200 MHz and 250 MHz, a sum of the length of the second edge 115 ($L_{115}$) and the length of the third edge 116 ($L_{116}$) falls in a range between 300 mm and 380 mm. In some embodiments, the sum of the length of the second edge 115 ($L_{115}$) and the length of the third edge 116 ($L_{116}$) falls in a range between 330 mm and 370 mm. In the first embodiment, a ratio of the length of the second edge 115 to the length of the third edge 116 is 0.75:1 ($L_{115}$:$L_{116}$=0.75:1), but is not limited to this disclosure.

Furthermore, in order to maintain or enhance the antenna gain of the flat antenna in an ultra high frequency (UHF) range (particularly in a frequency range between 470 MHz and 700 MHz used for the digital television channels), for each of the radiation units 1, some dimensions of the main radiating body 11 are specified below.

In order to enhance the antenna gain in a frequency range between 375 MHz and 750 MHz, the length of the second edge 115 ($L_{115}$) falls in a range between 100 mm and 200 mm to enhance the antenna gain in a frequency band between 375 MHz and 750 MHz. In some embodiments, the length of the second edge 115 ($L_{115}$) falls in a range between 130 mm and 170 mm.

In order to enhance the antenna gain in a frequency band between 250 MHz and 375 MHz, the length of the first edge 114 ($L_{114}$) falls in a range between 200 mm and 300 mm. In some embodiments, the length of the first edge 114 ($L_{114}$) falls in a range between 240 mm and 280 mm.

Referring to FIG. 2, a solid line 91 represents the antenna gain of the flat antenna of the first embodiment according to this disclosure, and a dashed line 92 represents antenna gain of the conventional flat antenna. By comparing the solid line 91 and the dashed line 92, it is clear that the antenna gain of the flat antenna according to this disclosure is better than that of the conventional flat antenna at the frequency band between 470 MHz and 700 MHz. Further, it is clear from FIG. 2 that the antenna gain of the flat antenna of this embodiment shows significant improvement in the frequency band between 174 MHz and 230 MHz. More specifically, in the frequency band between 174 MHz and 230 MHz, a lowest value of the antenna gain of the conventional flat antenna is less than −21 dB, while a lowest value of the antenna gain of the flat antenna according to this disclosure is not less than −14 dB. In comparison with the conventional flat antenna, the antenna gain of the flat antenna of this embodiment is increased by 7 dB in this frequency band.

Figure 3:
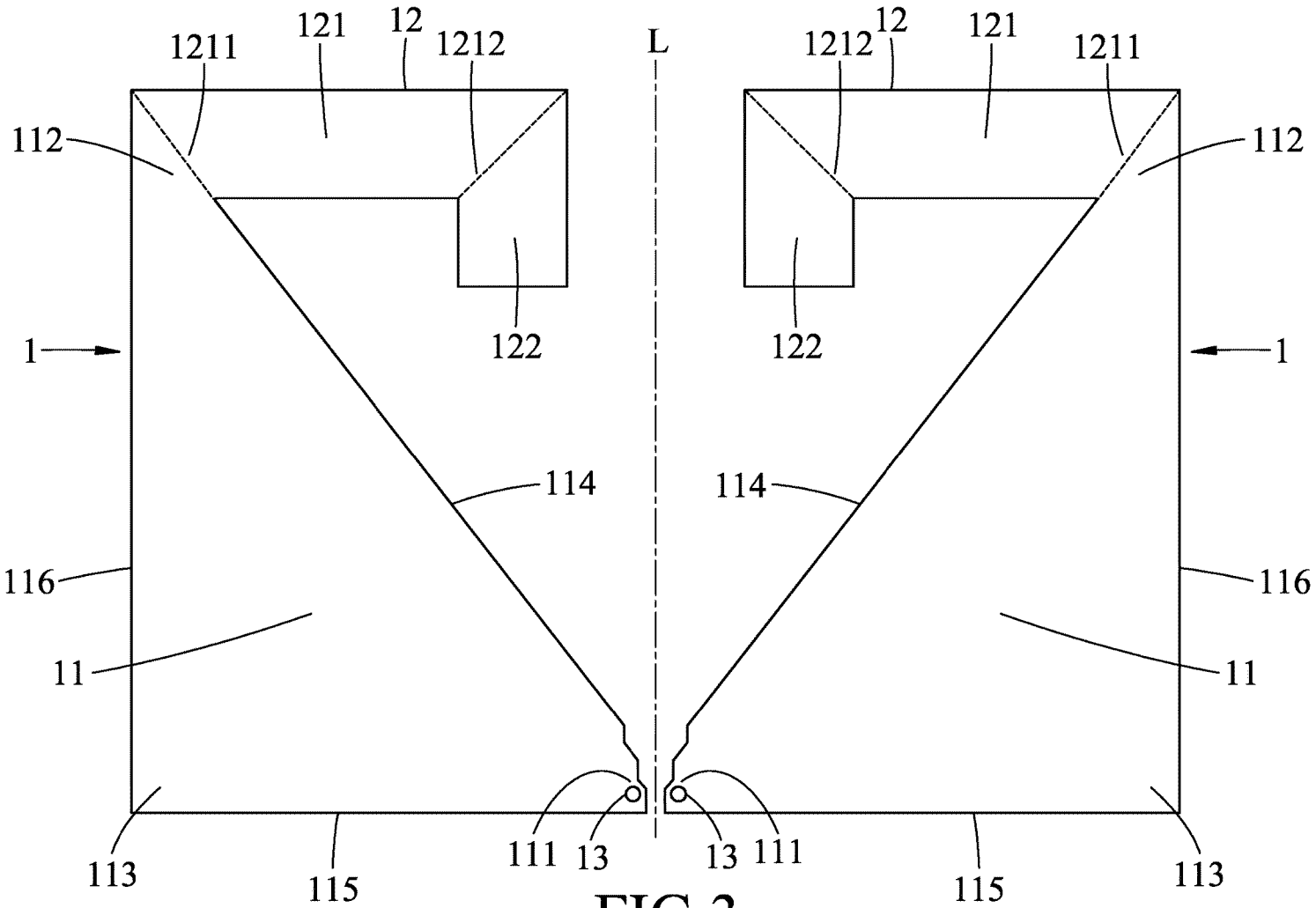
FIG. 3 is a schematic view of a second embodiment of the flat antenna according to the disclosure.

Referring to FIG. 3, a second embodiment of the flat antenna according to the disclosure is shown. The difference between the first embodiment and the second embodiment lies in the auxiliary radiating body 12. In the second embodiment, the auxiliary radiating body 12 includes a first segment 121 and a second segment 122. The first segment 121 is substantially elongated, is connected to the second angle 112, and extends from the first edge 114 in the first direction substantially perpendicular to the third edge 116. The first segment 121 has a connecting end 1211 connected to the second angle 112, and a distal end 1212 opposite to the connecting end 1211. The second segment 122 extends from the distal end 1212 of the first segment 121 toward the first edge 114 in a second direction substantially parallel with the third edge 116.

In order to provide the antenna gain as good as that of the first embodiment, the length of the auxiliary radiating body 12 extending from the main radiating body 11 in the second embodiment is the same as that in the first embodiment. Additionally, a ratio of a length of the first segment 121 ($L_{121}$) to a length of the second segment 122 ($L_{122}$) is 2.375:1 ($L_{121}$:$L_{122}$=2.375:1). It should be noted that features described above are not limited to the specific values described above. In one embodiment, the length of the first segment 121 ($L_{121}$) may be the same as the length of the auxiliary radiating body 12 of the first embodiment.

Consequently, the antenna gain of the flat antenna of this embodiment in both the VHF range and the UHF range has been improved similar to the antenna gain of the flat antenna of the first embodiment. Furthermore, due to the second segment 122 that is perpendicular to the first segment 121, the length of the auxiliary radiating body 12 may further extend so as to provide an electrical length longer than an electrical length of the auxiliary radiating body 12 of the first embodiment, so that the frequency range of the flat antenna of this embodiment may extend to a relatively lower frequency.

Figure 4:
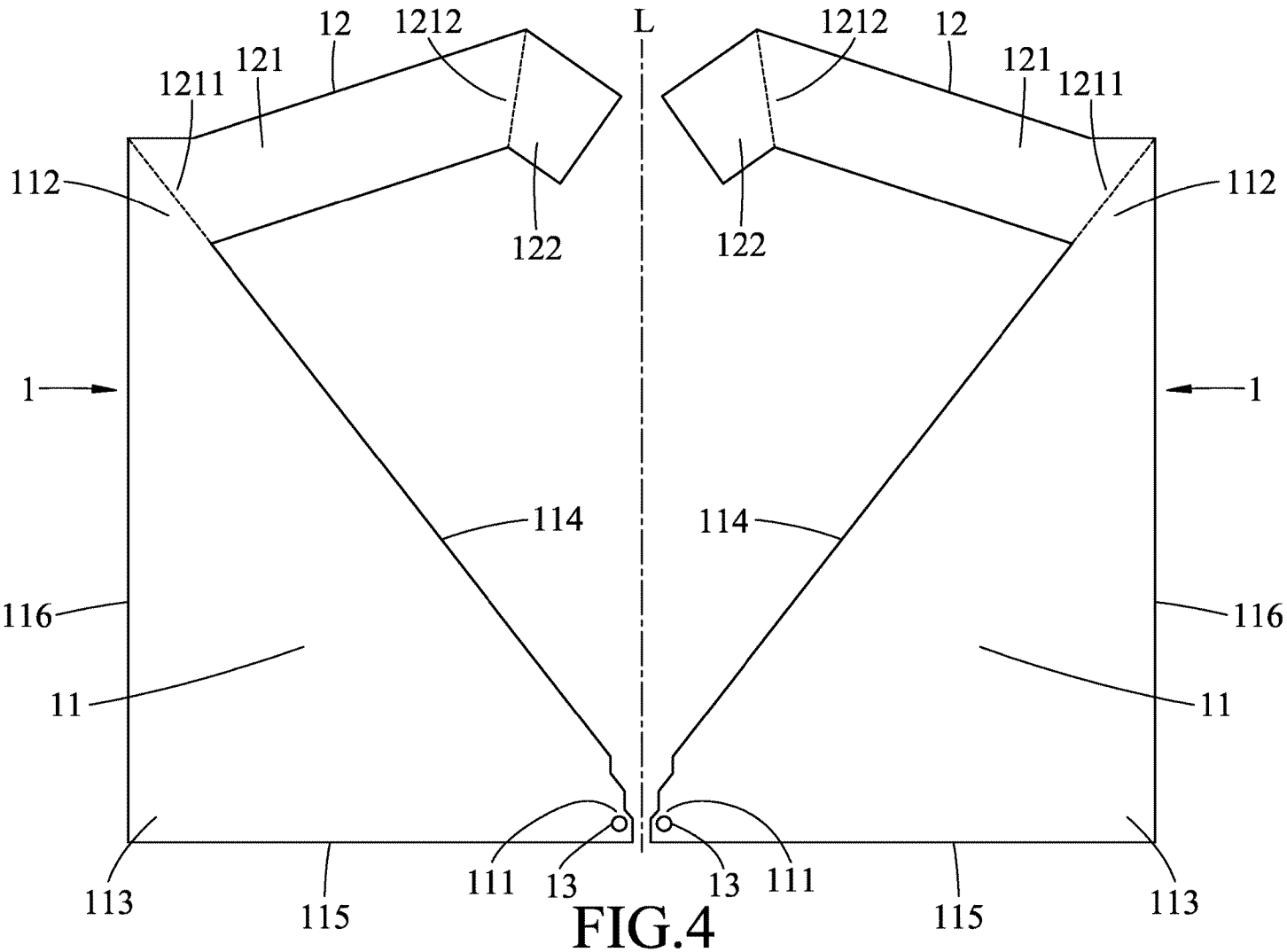
FIG. 4 is a schematic view of a third embodiment of the flat antenna according to the disclosure.

Referring to FIG. 4, a third embodiment of the flat antenna is shown. The difference between the first embodiment and the third embodiment also lies in the auxiliary radiating body 12.

In the third embodiment, the auxiliary radiating body 12 is substantially elongated and includes a first segment 121 and a second segment 122. The first segment 121 obliquely extends from the first edge 114 in a direction away from the second edge 115. The first segment 121 has a connecting end 1211 connected to the second angle 112, and a distal end 1212 opposite to the connecting end 1211. The second segment 122 obliquely extends from the distal end 1212 of the first segment 121 in a direction toward the second edge 115.

In order to provide the antenna gain as good as that of the first embodiment, the length of the auxiliary radiating body 12 extending from the main radiating body 11 in the third embodiment is the same as that in the first embodiment. Additionally, a ratio of a length of the first segment 121 ($L_{121}$) to a length of the second segment 122 ($L_{122}$) is 3.5:1 ($L_{121}$:$L_{122}$=3.5:1). It should be noted that features described above are not limited to the specific values described above.

Consequently, the antenna gain of the flat antenna of this embodiment in both the VHF range and the UHF range has been improved similar to the antenna gain of the flat antenna of the first embodiment. Furthermore, in comparison with the first embodiment, by virtue of the first and second segments 121, 122 that are bent, the third embodiment of the flat antenna may have a relatively wide direction of polarization and thus may reduce dead spots in receiving signals.

In summary, by virtue of the auxiliary radiating body 12 that extends from the first edge 114 of the main radiating body 11 toward the symmetrical axis (L), each of the radiation units 1 of the flat antenna according to the disclosure may have an electrical length that is longer than an electrical length of the conventional flat antenna. Accordingly, the antenna gain of the flat antenna at the VHF range is improved. Additionally, the radiation units 1 are spaced apart from and not physically connected to each other, and thus the radiation units 1 do not act as a folded dipole antenna and there is no loop current generated on the radiation units 1. Accordingly, the antenna gain may be not influenced by a conductor near the flat antenna (e.g., the coaxial cable).

Furthermore, by virtue of the geometric design of each of the radiation units 1, the antenna gain of the flat antenna at the frequency range from 174 MHz and 230 MHz is increased by 7 dB at most.

In addition, the flat antenna has a capacitance resulting from a gap between the auxiliary radiating bodies 12 respectively of the radiation units 1. Because of the capacitance, the flat antenna may be capable of reducing noise signals at the frequency range between 230 MHz and 470 MHz. As shown in FIG. 2, interference attributed to noise signals is alleviated at the frequency range between 230 MHz and 470 MHz.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A flat antenna comprising:

a pair of radiation units that are spaced apart from each other and that are symmetrical with respect to a symmetrical axis, each of said radiation units including a main radiating body that has a substantially triangular shape and that includes a first angle close to the symmetrical axis, a second angle and a third angle far from the symmetrical axis with respect to said first angle, a first edge between said first and second angles and obliquely facing the symmetrical axis, a second edge between said first and third angles, and a third edge between said second and third angles, an auxiliary radiating body that is connected to said main radiating body only at said second angle and that extends from said first edge toward the symmetrical axis, and a feed-in point that is formed on said first angle of said main radiating body.

2. The flat antenna of claim 1, wherein said auxiliary radiating body is substantially elongated and extends in a direction substantially perpendicular to said third edge.

3. The flat antenna of claim 2, wherein said third edge is substantially parallel with the symmetrical axis, and said second edge is substantially perpendicular to said third edge.

4. The flat antenna of claim 1, wherein said auxiliary radiating body is substantially elongated and includes:

a first segment obliquely extending from said first edge in a direction away from said second edge, said first segment having a connecting end connected to said second angle and a distal end opposite to said connecting end; and a second segment obliquely extending from said distal end of said first segment in a direction toward said second edge.

5. The flat antenna of claim 4, wherein said third edge is substantially parallel with the symmetrical axis, and said second edge is substantially perpendicular to said third edge.

6. The flat antenna of claim 1, wherein a sum of a length of said second edge, a length of said third edge and a length of said auxiliary radiating body falls in a range between 430 mm and 530 mm.

7. The flat antenna of claim 1, wherein a sum of a length of said first edge and a length of said third edge falls in a range between 300 mm and 480 mm.

8. The flat antenna of claim 1, wherein a sum of a length of said first edge and a length of said auxiliary radiating body falls in a range between 340 mm and 420 mm.

9. The flat antenna of claim 1, wherein a sum of a length of said second edge and a length of said third edge falls in a range between 300 mm and 380 mm.

10. The flat antenna of claim 1, wherein a length of said first edge falls in a range between 200 mm and 300 mm.

11. The flat antenna of claim 1, wherein a length of said second edge falls in a range between 100 mm and 200 mm.

12. A flat antenna comprising:

a pair of radiation units that are spaced apart from each other and that are symmetrical with respect to a symmetrical axis, each of said radiation units including a main radiating body that has a substantially triangular shape and that includes a first angle close to the symmetrical axis, a second angle and a third angle far from the symmetrical axis with respect to said first angle, a first edge between said first and second angles and obliquely facing the symmetrical axis, a second edge between said first and third angles, and a third edge between said second and third angles, an auxiliary radiating body that is connected to said second angle of said main radiating body and that extends from said first edge toward the symmetrical axis, and a feed-in point that is formed on said first angle of said main radiating body wherein said auxiliary radiating body includes:

a first segment being substantially elongated and extending from said first edge in a direction substantially perpendicular to said third edge, said first segment having a connecting end connected to said second angle and a distal end opposite to said connecting end; and a second segment extending from said distal end of said first segment toward said first edge in a direction substantially parallel with said third edge.

13. The flat antenna of claim 12, wherein said third edge is substantially parallel with the symmetrical axis, and said second edge is substantially perpendicular to said third edge.

* * * * *